US009073095B2

(12) United States Patent
Mayer Goyenechea Caballero

(10) Patent No.: US 9,073,095 B2
(45) Date of Patent: Jul. 7, 2015

(54) SYSTEM AND PROCESS FOR WIRE CLEANING IN A GALVANIZING PRODUCTION LINE

(76) Inventor: Juan Antonio Mayer Goyenechea Caballero, Zinacantepec (MX)

( * ) Notice: Subject to any disclaimer, the term of this patent is extended or adjusted under 35 U.S.C. 154(b) by 210 days.

(21) Appl. No.: 13/640,123

(22) PCT Filed: Apr. 11, 2011

(86) PCT No.: PCT/IB2011/000800

§ 371 (c)(1),
(2), (4) Date: Oct. 9, 2012

(87) PCT Pub. No.: WO2011/128753

PCT Pub. Date: Oct. 20, 2011

(65) Prior Publication Data

US 2013/0025631 A1 Jan. 31, 2013

Related U.S. Application Data

(60) Provisional application No. 61/323,523, filed on Apr. 13, 2010.

(51) Int. Cl.
*B08B 1/00* (2006.01)
*B08B 1/02* (2006.01)

(52) U.S. Cl.
CPC .. *B08B 1/002* (2013.01); *B08B 1/02* (2013.01)

(58) Field of Classification Search
None
See application file for complete search history.

(56) References Cited

U.S. PATENT DOCUMENTS

| | | | | | |
|---|---|---|---|---|---|
| 4,298,207 | A | * | 11/1981 | Hopper et al. | 277/652 |
| 4,390,377 | A | * | 6/1983 | Hogg | 148/518 |
| 4,452,279 | A | | 6/1984 | Atwell | |
| 5,188,376 | A | | 2/1993 | Ueda et al. | |
| 5,849,052 | A | * | 12/1998 | Barber, Jr. | 51/298 |
| 2001/0051498 | A1 | * | 12/2001 | Bailey et al. | 451/49 |
| 2003/0134577 | A1 | * | 7/2003 | Coad | 451/41 |
| 2007/0202315 | A1 | * | 8/2007 | Duffield et al. | 428/304.4 |

OTHER PUBLICATIONS

International Search Report for PCT/IB2011/000800, dated Oct. 21, 2011.

* cited by examiner

*Primary Examiner* — Nicole Blan
(74) *Attorney, Agent, or Firm* — Roylance, Abrams, Berdo & Goodman, L.L.P.

(57) ABSTRACT

A cleaning package for wires, method and system comprising said cleaning package, the package comprising a fiber-glass core, a synthetic fiber coating layer surrounding the fiber-glass core and interlaced with said fiber-glass core, and a coating layer surrounding, at least in part, the synthetic fiber coating layer, wherein the coating layer is a thermoplastic layer. The cooled-off galvanized wire is passed in between the at least two cleaning packages at a speed of up to 250 meters per second, while lasting up to eight hours.

12 Claims, 6 Drawing Sheets

SYSTEM AND PROCESS FOR WIRE CLEANING IN A GALVANIZING PRODUCTION LINE

FIELD OF THE INVENTION

The present invention refers to a cleaning package for wires and more specifically to a system and process for achieving a desired finish and cleanliness in a hot-dip galvanization or anticorrosive process of a wire which has been controllably immersed in liquid zinc. Specifically the galvanization process of the wire consists of coating the wire with a uniform and brilliant layer of zinc under determined circumstances.

BRIEF SUMMARY OF THE INVENTION

The present invention refers to a package cleaning system and method to achieve a desired finish in the hot-dip galvanization or anticorrosive process of a wire which has been immersed in zinc at a temperature of between 400 to 490° C., preferably between approximately 440 to 460° C., avoiding thus physical decomposition of the low steel metal wires in carbon. The hot-dip galvanization process consists of coating the wire with a uniform and brilliant zinc layer, the zinc layer normally being of at least 0.07112 mm in diameter, not including the diameter of the wire. However, the wire and layer can be in many different diameters or sizes.

The coated wire is then cooled, preferably with water splash, to a determined temperature so that it may then be passed in between two or more cleaning packages to discard zinc excess. In the prior art, this cleaning of the zinc coating was achieved with packages at a speed of less than 40 meters per minute, however, with the packages, system and process of the present invention, the cleaning packages may process the coated wires at a speed of 250 (250) meters per minute. Furthermore the galvanizing or coating layer diameter (amount of zinc coating the wire) may be controlled with greater precision, thus achieving international galvanizing standards. This substantially improves the resistance and functionality of the cleaning packages.

The hot-dip galvanization process usually consists of a liquid zinc tub wherein the zinc is heated to temperatures of about 450° C. to 490° C., in which about 15 to 30 wires per tub are immersed at the same time, providing the required zinc coating to the wires. Once the wires are coated with zinc, the wires are cooled to temperatures of between 210° C. to 290° C. The coated wires are cooled off preferably with water. The cooled coated wires are then passed in between two cleaning packages at the above cooled temperatures at speed rates of between 50 to 250 meters per minute and more.

The cleaning packages for wire galvanizing production lines of the present invention, limit or discard the impregnated zinc excess in the galvanized steel wire. These cleaning packages are placed in pairs within a housing, and the wire is passed between the pair of cleaning packages and hence the zinc quantity coated is kept within the allowable limits according to the diameter of the wire. Furthermore, the cleaning packages of the present invention allow avoiding the use of cooling fluid to the housings of the package; that is, cooling fluid to cool the housings in which the pair of packages are present is dispensed of.

Therefore the cleaning packages are submitted to strong temperature changes, since they must support the outgoing temperature of the coated wires which have been cooled off after the tub immersion, as well as the friction between the wire and said packages, therefore, the cleaning package must bear temperatures of more than about 250° C., and likewise support the cooling of the wire, which passes in between the cleaning packages, producing thermal shocks in the cleaning package which many materials do not withhold.

The basic function of the cleaning package is to provide a defined zinc layer over the wire, that is, a defined finish of the wire, expressed in wire diameter, weight by area of the wire, finish of the wire which must be smooth and without imperfections. This finishing of the wire is done at a speed of between 50 to 250 meters per minute, and above. In the prior art, the rate of cleaning a wire is of about 20 to 40 meters per minute, therefore the packages of present invention provides a great speed increase over the prior art.

Finally, another problem is that the durability of the conventional cleaning packages, which according to the prior art is up to 2 hours, causing halts in the wire production lines to change the cleaning packages, and thus diminishing the productivity of the plant.

The wire cleaning package for galvanizing lines of the present invention overcomes the above deficiencies providing a duration of between 6 to 10 hours of each package, at a speed of between about 180 to 250 meters per minute. Therefore, this provides a second advantage over the cleaning packages of the prior art, giving the production lines a greater continuous production time length plus much higher production speed.

One of the important aspects of the present invention is to provide a wire packaging cleaner for galvanizing wire line production that does not contain asbestos in its structure, due to its hazardous risk for the human health. Another objective of the present invention is providing a package cleaner which contains a combination of materials which allows the below aspects.

A further aspect of the invention is providing a wire cleaning packaging system for finishing the galvanized areas of the wire at high production speed, while at the same time manufacturing a high quality wire.

Furthermore, another aspect of the invention is providing a wire cleaning packaging for galvanization wire production lines that has an 8 hour durability, which increases productivity, making packaging changes only once per work shift, hence having a 4 to 1 durability with regards to traditional asbestos packaging.

Another aspect of the invention is providing a cleaning package which allows wire cleaning speeds of 250 meters per minute or more.

Yet a further aspect of the invention is providing a cleaning system for hot-dipped galvanized wires in which after the wire is immersed in a zinc tub and cooled off, the wire is passed in between a pair of cleaning packages at the above-mentioned speeds.

Another aspect of the invention is providing a wire cleaning method, in which the wire is immersed in a zinc tub, cooled off and cleaned at the above-mentioned speeds.

BRIEF DESCRIPTION OF THE DRAWINGS

The present invention will be further understood when referenced with the following detailed description and with the following figures. Additionally, other aspects will become apparent when referenced with the detailed descriptions along with the following figures.

DETAILED DESCRIPTION OF THE INVENTION

The use of the term "about" provides an additional determined range. The term is defined in the following manner: the additional range provided by the term is that of approximately ±10%. As an example, but not in a limitative manner, if it states "between about 20 to 40 meters per minute", the exact range could vary between 18 to 44 meters per second, or between 22 to 44 meters per minute, or between 18 to 36 meters per minute or between 22 and 36 meters per minute. Any of the possibilities previously described are covered through the term "about" or synonyms thereof.

Figure 1:
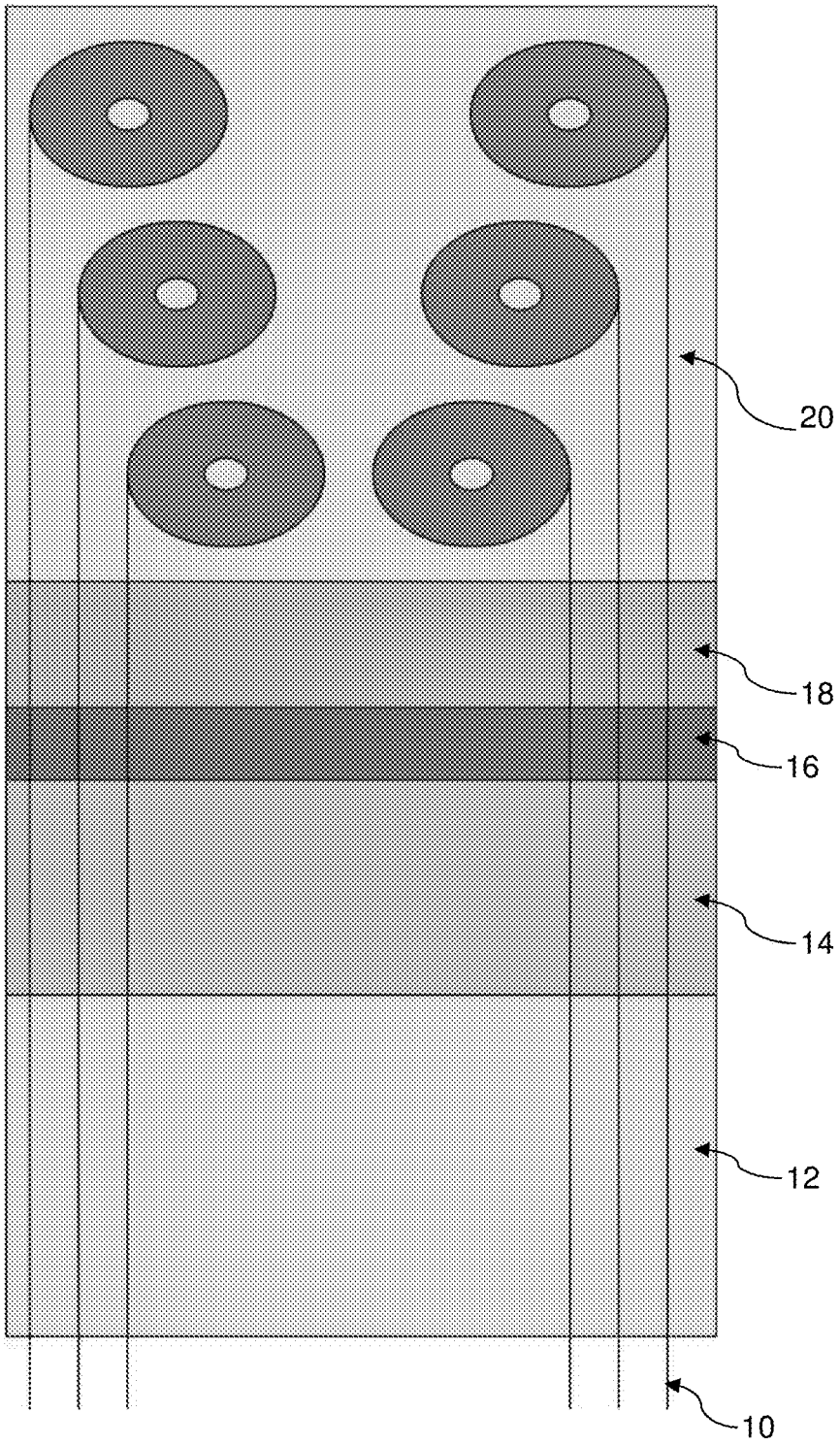
FIG. 1 shows a wire galvanizing production line and its different steps throughout the production line.
Figure 2:
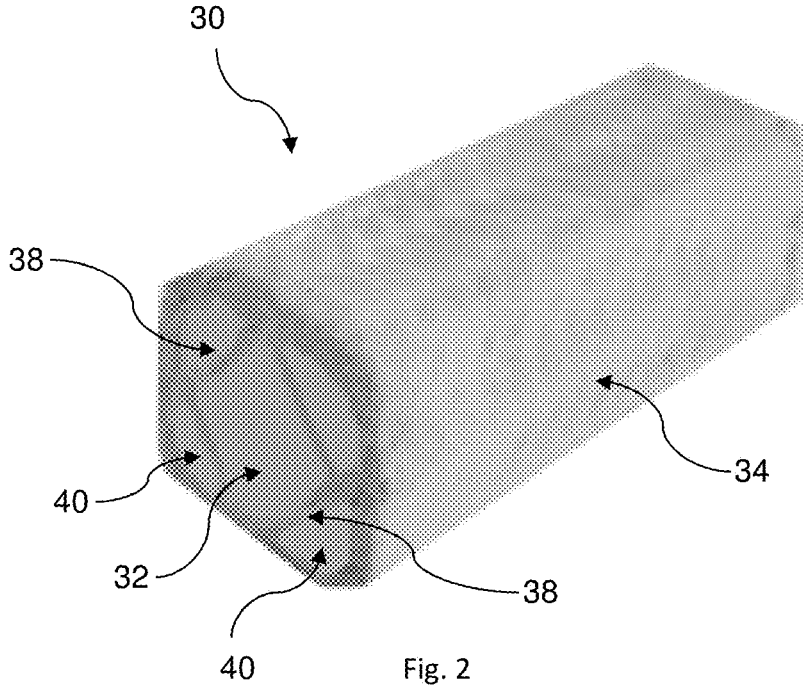
FIG. 2 shows a conventional perspective view of a cleaning package of the present invention made of fiber glass and aramid fiber, as well as other compounds.
Figure 3:
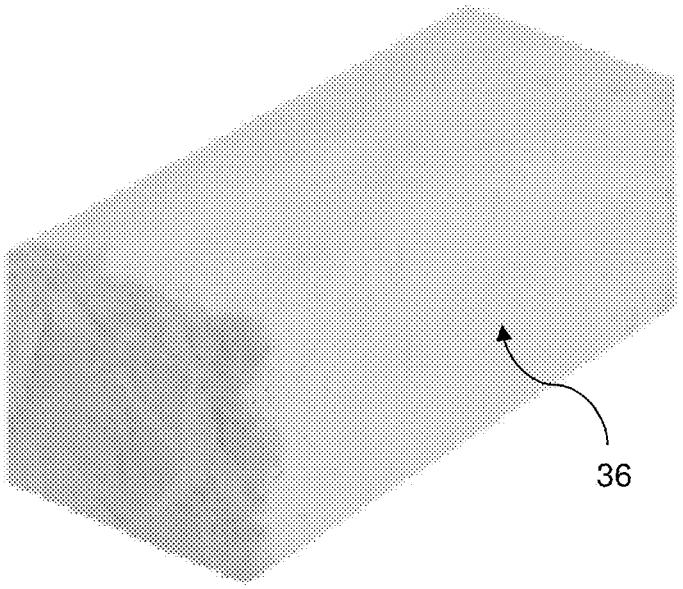
FIG. 3 shows a conventional perspective view of a cleaning constituted of fiber glass.
Figure 4:
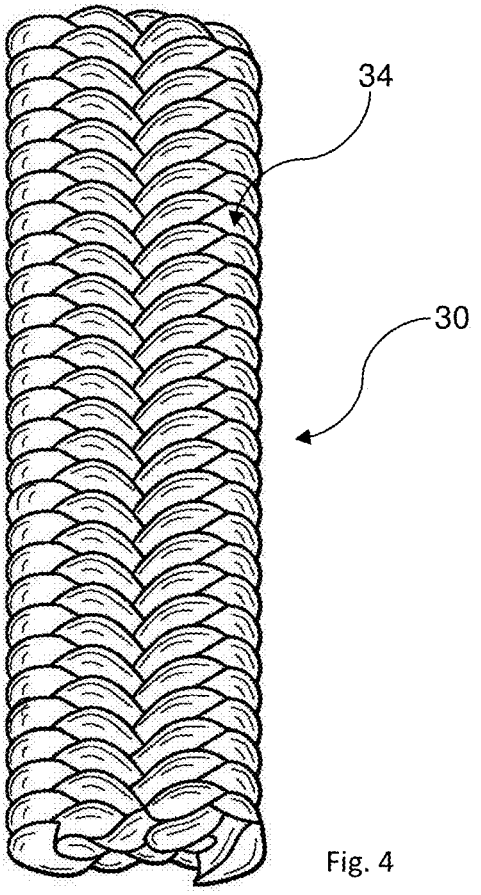
FIG. 4 shows an upper view of the cleaning package.
Figure 5:
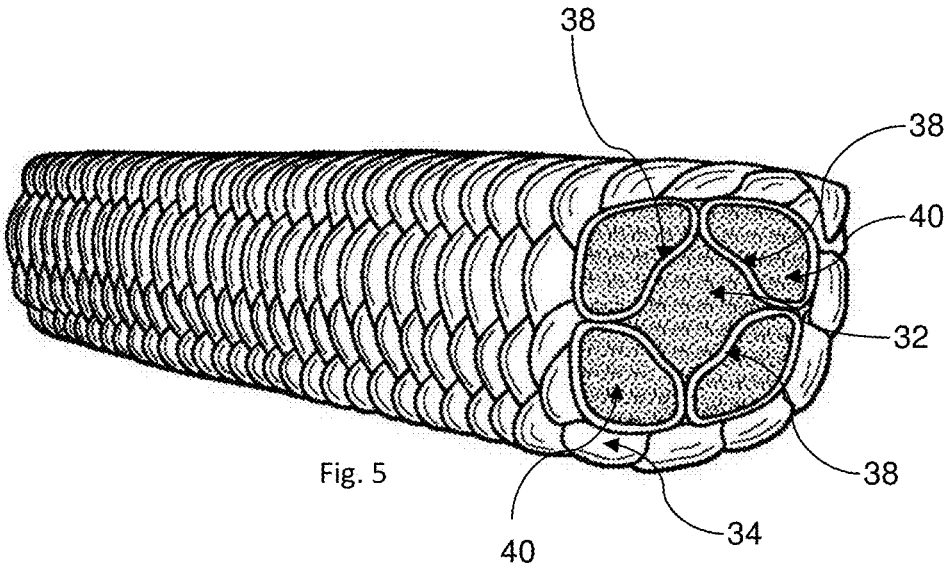
FIG. 5 shows a front conventional perspective view of the cleaning package.
Figure 6:
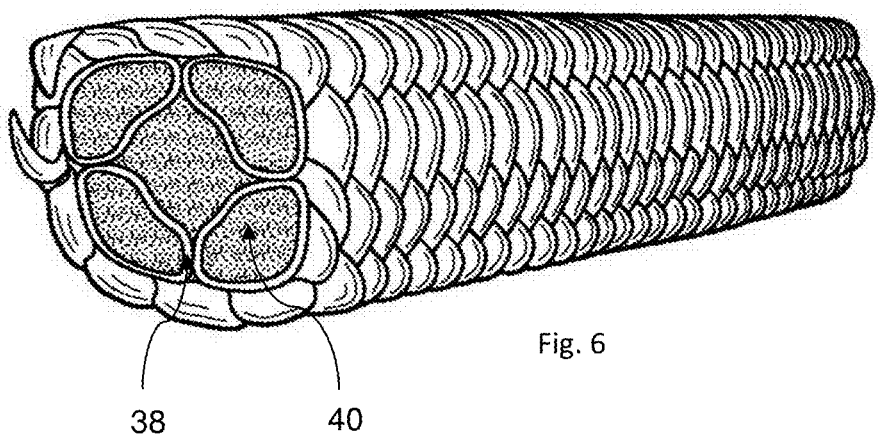
FIG. 6 shows a rear conventional perspective view of the cleaning package.
Figure 7:
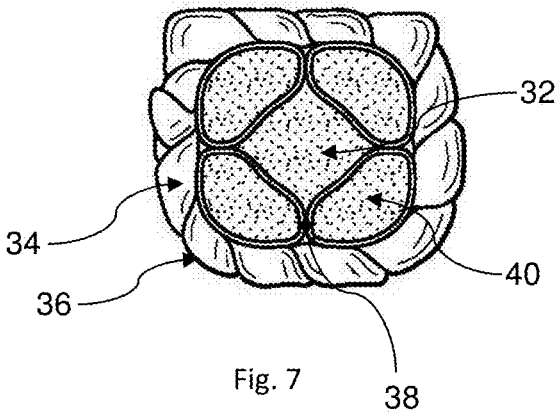
FIG. 7 shows a front view of the cleaning package.
Figure 8:
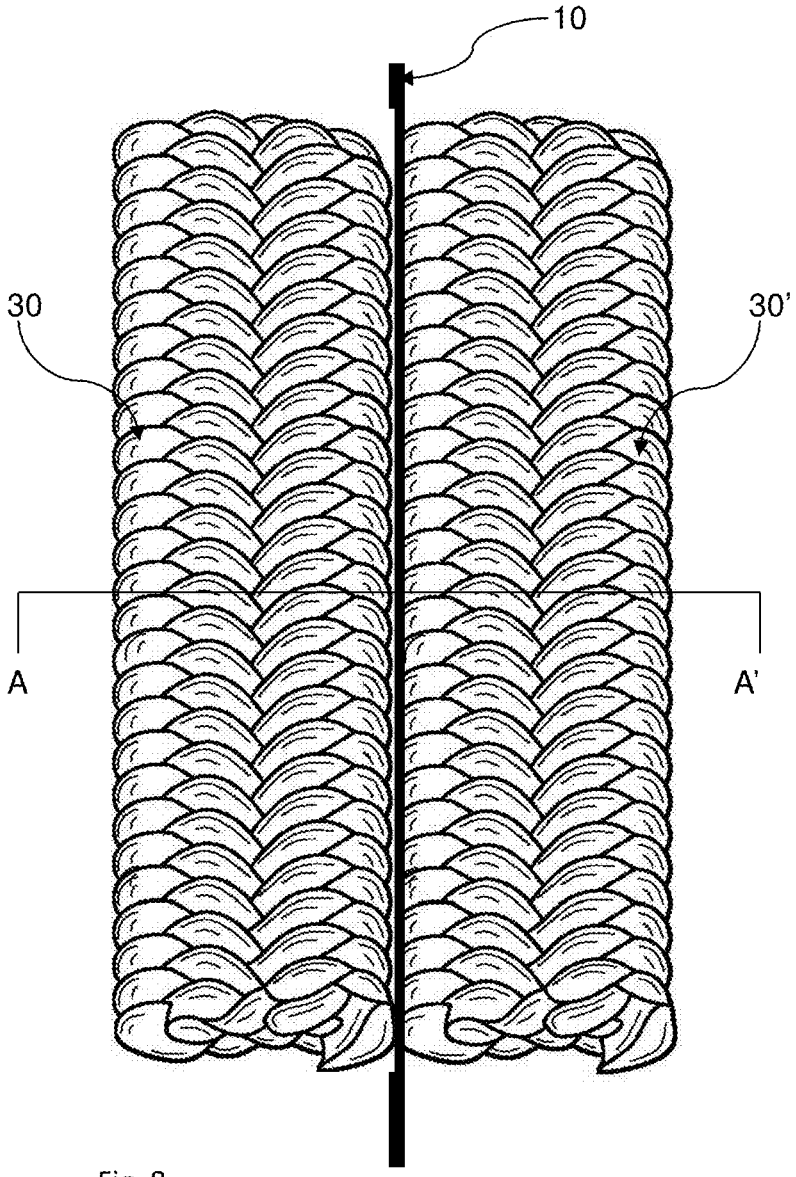
FIG. 8 shows an upper view of the wire cleaning system with a pair of packages cleaning the wire.
Figure 9:
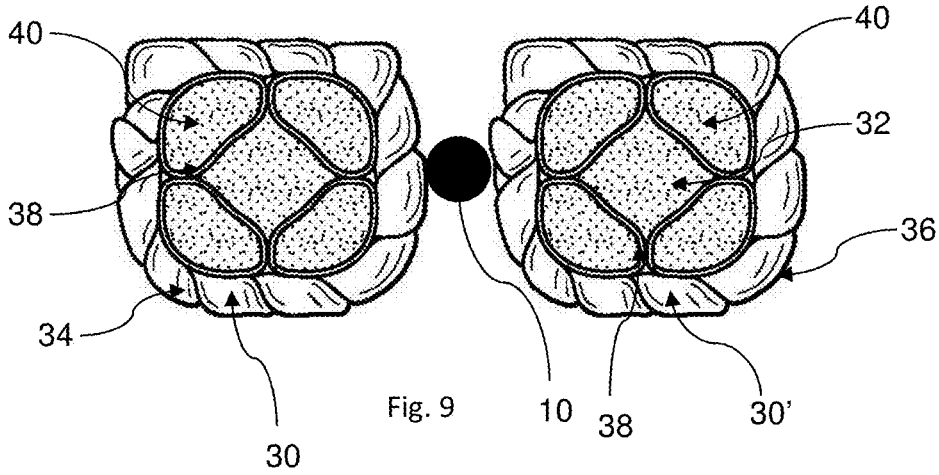
FIG. 9 shows a transversal cut along the A-A' lines of FIG. 8, showing the wire in between a pair of cleaning packages.
Figure 10:
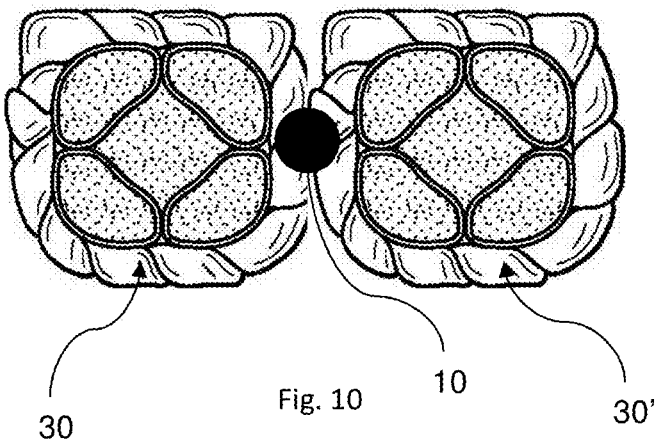
FIG. 10 shows a transversal cut along the A-A' lines of FIG. 8, showing the wire in between a pair of cleaning packages.

The following description is made in reference to FIGS. 1, 8 and 9. The present invention refers to a packaging cleaning, and a system and method thereof, to achieve a desired finish in a wire 10 which has been hot-dipped galvanized or has been passed through an anticorrosive process, wherein the wire 10 has been immersed in zinc. The zinc is usually heated 12 in a tub 14. It is usual in these processes that the temperature which the zinc achieves for hot-dipping the wire is of between 400 to 490° C., preferably about 460° C., avoiding thus physical decomposition of the low steel metal wires in carbon. The hot-dip galvanization process consists of coating the wire with a uniform and brilliant zinc layer, the layer being of at least about 0.07112 mm in diameter, not including the diameter of the wire. Given that the hot-dip galvanization process through which the wires are galvanized in zinc with, is not an exact process, the wire may be left with more than the desired diameter of zinc coating, or may have uneven coating which affects the visual appearance of the wire and could affect the performance of the wire. Therefore, it is desired that the finished wire has a constant zinc coating layer throughout the entire wire length. Wires are therefore cleaned for excess coating.

Once the wire has been hot-dipped galvanized in a tub 14, the coated wire is then cooled 16 to a determined temperature so that it may then be passed in between 18 two or more cleaning packages to discard zinc excess. As stated above, the liquid zinc in the tubs 14 is heated to temperatures of about 400 to 490° C., preferably about 460° C., in which generally about between 15 to 30 wires 10 per tub 14 are immersed at the same time, providing the required zinc coating to the metallic wire by means of said hot-dipped galvanization. Once 10 the wires are coated with zinc, the wires are cooled 16 to temperatures of between 210° C. to 290° C., and more preferably about 250° C. The coated wires 10 are cooled off 16 preferably with water.

The cooled coated wires are then passed in between 18 at least two cleaning packages 30, 30' at the above cooled temperatures at speed rates of 250 meters per minute or more, and more preferably at speeds of between 50 to 225 meters per minute and even more preferably of speeds between about 180 to 220 meters per minute. In an embodiment, speeds of 50 to 180 meters per minute may be achieved. The cleaning packages 30, 30' for wire galvanizing production lines of the present invention, limit and discard the impregnated zinc excess which the steel wire 10 acquired during the hot-dip galvanization within the tub 14. These cleaning packages 30, 30' are placed in pairs within a housing (not shown) and the wire 10 is passed between the pair of cleaning packages 30, 30' and hence the zinc quantity is kept within the allowable limits according to the diameter of the wire. The housing limits the movement of the cleaning packages 30, 30' when the cooled galvanized wire 10 passes in between 18 said cleaning packages. Furthermore, the cleaning packages 30, 30' of the present invention allow avoiding the use of cooling fluid to the housings of the package; that is, cooling fluid to cool the housings in which the pair of packages are present is dispensed of. Since the wire 10 passes in between 18 the two cleaning packages 30, 30', the wire 10 abuts in at least two of its ends the cleaning packages. Preferably, the cleaning packages 30, 30' are joined in such a manner that the cleaning packages abut each other, and the wire is passed in between said cleaning packages, so that all of the faces of the wire may be properly cleaned. Since the wire 10 abuts with the cleaning packages 30, 30', preferably all the faces of the wire, so that the wire is evenly cleaned, the amount of friction between the wire and the cleaning packages is constant. The amount of friction increases when the passing of the wire 10 in between the packages 30, 30' increases its speed. The amount of friction between the packages and the wire at a speed of 20 meters per minute is quite different to the friction between the packages and the wire at 255 meters per minute. Therefore, the cleaning packages 30, 30', or at least part of the cleaning packages need to be lubricated so as to endure the passing of the wire.

Thus the cleaning packages 30, 30' are submitted to strong temperature changes, since they must support the outgoing temperature of the cooled off coated wires 10 as well as supporting the friction of the wires frictionally passing in between them and the outgoing temperature of the cleaned cooled off coated wires. As stated above, the wires have been cooled off after the tub 14 immersion, therefore, the cleaning package 30, 30' must bear temperatures of more than about 250° C., and likewise support the cooling of the wire whose passing through the cleaning packages causes friction, hence producing thermal shocks.

The basic function of the cleaning package 30, 30' is to provide a defined zinc layer over the wire 10, that is, a defined finish of the wire, expressed in wire diameter, weight by area of the wire and/or finish of the wire which must be smooth and without imperfections.

After the clean cooled galvanized wire 10 has been cleaned of zinc excess, the wire 10 may then be cooled off for a second period of time. When the outgoing wire 10 finishes its cleaning process in the cleaning packages 30, 30', the wire still has temperatures above 200° C. Therefore, to roll the wire, the temperature of the wire preferably needs to be below 200° C., and preferably below 180° C. This second cooling off may also be carried out with water.

Finally, the wires are rolled 20 for their transport.

The following description is made with reference to FIGS. 2 through 7. The cleaning package 30, 30' is preferably made out of a core 32, a first coating layer 34 surrounding the core and a second coating layer 36 surrounding the first coating layer. Intermediate coating layers 38, as well as intermediate cores 40 between the intermediate coating layers 38 and the first coating layer may be provided in the cleaning package 30, 30'. If intermediate cores 40 are present, the intermediate layers 38 are interlaced with the core 32, the intermediate cores 40 and the first coating layer 34. If only the core 32 and the first and second coating layers 34, 36 are present, then only the first coating layer interlaces with the core 32.

The core 32 and the intermediate cores 40 are preferably made out of fiber glass. The first coating layer and the intermediate coating layers 38 are synthetic fibers, preferably aramid fibers. The second coating layer 36 may be selected from different combinations, such as (a) a thermoplastic layer and a mineral lubrication, (b) an elastomeric base mixture, a thermoplastic layer and a mineral lubrication or (c) a thermoplastic layer, an organic coating and a mineral lubrication. The thermoplastic and elastomeric layers are preferably selected among the group of polytetrafluoroethylene, perfluoroalkoxy, fluorinated ethylene propylene or a similar polymer. The preferred thermoplastic is polytetrafluoroethylene. The preferred mineral is vermiculite, however other minerals with the same properties of exfoliation may be used. The preferred organic coating is made out of siloxanes and more preferably silicone, by means of silicone grease and mineral oils, which may be selected among paraffinic oils, naphtenic oils and aromatic oils.

The advantage of using fiber glass as the core 32 is the resistance the fiber glass has to high temperatures, which will be needed in view of the temperature the ingoing galvanized wire has and the friction produced by the contact between the wire 10 and the packages 30, 30'. The core material forms most of the volume of the cleaning package. The advantage of using aramid fiber as the synthetic fiber of the first coating layer is the resistance provided by such fiber. These fibers provide the necessary resistance in regards to the friction generated when the wire 10 is passed in between the two cleaning packages 30, 30'. The thermoplastic and elastomer are used to allow a better sliding of the wire 10 when the wire is passed in between the cleaning packages 30, 30' hence diminishing the friction between the wires and the cleaning package. The organic coating is used to protect the thermoplastic and elastomer from the high temperatures of the wire passing in between the cleaning packages 30, 30'.

Examples of Cleaning Package Formation

| Type | Construction | Application |
|---|---|---|
| EKV 103 731 T | Texturized fiber glass core, bound with an elastomer mixture, an outer layer of aramid fiber is applied, finished with a thermoplastic treatment | As a zinc cleaning package in galvanizing processes, useful for low coating speeds, with medium quality outer layers |
| EKV RAT 730 | Texturized fiber glass core, bound with PTFE, a outer layer of aramid fiber is applied, lubricated with mineral substances and finished with a thermo-plastic treatment | Zinc cleaning package in galvanizing processes, useful at mid coating speeds, with outer "mirror" finish of excellent quality |
| EKV RAT 730 MT | Texturized fiber glass core, bound with PTFE, a superficial layer of aramid fiber is applied, lubricated with mineral substances and finished with a high grade thermoplastic treatment | Zinc cleaning package in galvanizing processes, useful at high coating speeds, with superficial "mirror" finish of excellent quality |
| EKV 104 736 VE | Texturized fiber glass core, bound with PTFE, a superficial layer of aramid fiber is applied, lubricated with mineral substances and finished with a temperature resistant organic material, finished with a thermoplastic treatment | Zinc cleaning package in galvanizing processes, useful at mid coating speeds with high temperatures, with a good quality superficial finish, with better heat dissipation |
| EKV 105 736 VE MT | Texturized fiber glass core, bound with PTFE, a superficial layer of aramid fiber is applied, lubricated with mineral substances and coated with a temperature resistant organic material, finished with a thermoplastic treatment | Zinc cleaning package in galvanizing processes, useful at high coating speeds with high temperatures, with a good quality superficial finish, with better heat dissipation |

In the EKV 104 731 T cleaning package 30, the amount of fiber glass core 32 and intermediate cores 40 is between 36 to 76% of the total amount of the cleaning package, the elastomer layer mixture is between 2 to 22% of the total amount of the cleaning package, the aramid fiber 34 between 9 to 29% of the total amount of the cleaning package, and the thermoplastic layer of between 3-23% of the total amount of the cleaning package. In the EKV RAT 730 cleaning package 30 the amount of fiber glass core 32 and intermediate cores 40 is between 21 to 61% of the total amount of the cleaning package, the aramid fiber 34 between 4 to 44% of the total amount of the cleaning package, the thermoplastic layer between 10 to 40% of the total amount of the cleaning package, and 5 to 35% of lubricant mineral of the total amount of the cleaning package. In the EKV RAT 730 MT cleaning package 30 the amount of fiber glass core 32 and intermediate cores 40 is between 19 to 59% of the total amount of the cleaning package, the aramid fiber 34 between 7 to 47% of the total amount of the cleaning package, the thermoplastic layer between 5 to 45% of the total amount of the cleaning package, and 1 to 30% of lubricant mineral of the total amount of the cleaning package. In the EKV 104 736 VE cleaning package 30 the amount of fiber glass core 32 and intermediate cores 40 is between 7 to 47% of the total amount of the cleaning package, the aramid fiber 34 between 1 to 40% of the total amount of the cleaning package, the thermoplastic layer between 2 to 42% of the total amount of the cleaning package, the organic coating between 1 to 41% of the total amount of the cleaning package and 1 to 30% of lubricant mineral of the total amount of the cleaning package. In the EKV 105 736 VE MT cleaning package 30 the amount of fiber glass core 32 and intermediate cores 40 is between 5 to 45% of the total amount of the cleaning package, the aramid fiber 34 between 1 to 41% of the total amount of the cleaning package, the thermoplastic layer between 5 to 45% of the total amount of the cleaning package, the organic coating between 1 to 39% of the total amount of the cleaning package and 1 to 30% of lubricant mineral of the total amount of the cleaning package.

The wire cleaning package 30, 30' for galvanizing lines of the present invention has a duration of between 4 to 8 hours of each package, at a speed of between about 50 to 250 meters per minute; the duration of the cleaning package will depend upon the speed at which the wire is being passed. It has been noticed that at a speed of about 225 meters per minute, the cleaning packages needs to be changed every four hours; at a speed of about 220 meters per minute, the cleaning packages has to be changed every six hours, while at a speed of about 180 meters per minute, the cleaning packages need to be changed every eight hours. Therefore, this provides a second advantage over the cleaning packages of the prior art, giving the production lines a greater time length and speed. Therefore, while in the prior art a theoretical maximum of 4,800 meters of wire could be finished with two cleaning packages (a real maximum of 3,600 meters of wire), two cleaning packages 30, 30' of the present invention allow a maximum production of 86,400 meters of wire can be finished. Therefore, the advantage over the prior art is clear.

Alterations to the structure described in the present, shall be able to be foreseen by those with expertise in the field. However, it must be understood, that the present description is related with the preferred embodiments of the invention, which are solely for illustrative purposes, and must not be construed as a limitation of the invention. All modifications which do not depart from the spirit of the invention are included within the body of the attached claims.

The invention claimed is:

1. A cleaning package for wires, comprising:

a texturized fiber-glass core and at least one intermediate core made out of texturized fiber-glass;

intermediate coating layers made out of synthetic fibers;

a first coating layer made out of synthetic fibers;

a second coating layer surrounding the first coating layer selected from (a) a thermoplastic layer and vermiculite, or (b) an elastomeric base mixture, a thermoplastic layer and vermiculite; or (c) a thermoplastic layer, an organic coating and vermiculite, and wherein the intermediate coating layers are interlaced with the core, the at least one intermediate core and the first coating layer.

2. The cleaning package of claim 1, wherein the synthetic fiber is aramid fiber.

3. The cleaning package of claim 1, wherein the thermoplastic layer is selected among the group of polytetrafluoroethylene, perfluoroalkoxy, fluorinated ethylene propylene.

4. The cleaning package of claim 1, wherein the elastomeric base mixture is selected from the group consisting of polytetrafluoroethylene, perfluoroalkoxy, and fluorinated ethylene propylene.

5. The cleaning package of claim 1, wherein the organic coating is made out of siloxanes.

6. The cleaning package of claim 5, wherein the siloxane is silicone.

7. A method for cleaning a galvanized wire from zinc excess comprising:

receiving a galvanized wire at a temperature of between about 210° and 290° C., wherein the galvanized wire has been previously cooled off with water;

passing the galvanized wire in between at least two cleaning packages at a speed of between about 50 and 250 meters per second to clean the wire from zinc excess, the cleaning packages comprising:

a texturized fiber-glass core and at least one intermediate core made out of texturized fiber-glass;

intermediate coating layers made out of synthetic fibers;

a first coating layer made out of synthetic fibers;

a second coating layer surrounding the first coating layer selected from (a) a thermoplastic layer and vermiculite, (b) an elastomeric base mixture, a thermoplastic layer and vermiculite or (c) a thermoplastic layer, an organic coating and vermiculite, wherein the intermediate layers are interlaced with the core, the at least one intermediate core and the first coating layer; and rolling the clean galvanized wire.

8. The method of claim 7, wherein the cooled-off galvanized wire is received at a temperature of about 260° C.

9. The method of claim 7, wherein the cooled-off galvanized wire is passed in between the at least two cleaning packages at a speed of between about 50 and 225 meters per second.

10. The method of claim 7, wherein the cleaned cooled-off galvanized wire is cooled-off prior to storing the wire.

11. A system for producing a plurality of cleaned galvanized wires, clean from zinc excess, the system comprising:

a galvanizing medium in which the plurality of wires are galvanized;

a cooling-off medium comprising water in which the plurality of galvanized wires are cooled-off until reaching a temperature of between about 210° and 290° C.; and at least two cleaning packages within a housing per each cooled-off galvanized wire, for cleaning zinc excess from the plurality of cooled-off galvanized wires, the wire being subject to pass in between the at least two cleaning packages at a speed of between about 50 and 250 meters per second, the cleaning packages comprising:

a texturized fiber-glass core and at least one intermediate core made out of texturized fiber-glass;

intermediate coating layers made out of synthetic fibers;

a first coating layer made out of synthetic fibers;

a second coating layer surrounding the first coating layer selected from (a) a thermoplastic layer and vermiculite, (b) an elastomeric base mixture, a thermoplastic layer and vermiculite, or (c) a thermoplastic layer, an organic coating and vermiculite, wherein the intermediate coating layers are interlaced with the core, the at least one intermediate core and the first coating layer.

12. The system of claim 11, wherein the at least two cleaning packages are changed every:

four hours when the cooled-off galvanized wire is passed in between the at least two cleaning packages at a speed of about 225 meters per second;

every six hours when the cooled-off galvanized wire is passed in between the at least two cleaning packages at a speed of about 220 meters per second; or every eight hours when the cooled-off galvanized wire is passed in between the at least two cleaning packages at a speed of about 180 meters per second.

* * * * *